US006002307A

United States Patent [19]

Arakawa

[11] Patent Number: 6,002,307

[45] Date of Patent: Dec. 14, 1999

[54] DIELECTRIC FILTER AND DIELECTRIC DUPLEXER

[75] Inventor: Shigeji Arakawa, Kanazawa, Japan

[73] Assignee: Murata Manufacturing Co., Ltd., Japan

[21] Appl. No.: 09/014,738

[22] Filed: Jan. 28, 1998

[30] Foreign Application Priority Data

Jan. 29, 1997 [JP] Japan ..... 9-014889
Dec. 9, 1997 [JP] Japan ..... 9-338483

[51] Int. Cl.[6] ..... H01P 5/12; H01P 1/20

[52] U.S. Cl. ..... 333/135; 333/202; 333/208

[58] Field of Search ..... 333/202, 208, 333/209, 219.1, 230, 126, 129, 134, 135, 132

[56] References Cited

U.S. PATENT DOCUMENTS 4,607,242 8/1986 Cozzie ..... 333/208 X
4,691,179 9/1987 Blum et al. ..... 333/208 X
4,725,798 2/1988 Igarashi ..... 333/208 X
5,731,751 3/1998 Vangala ..... 333/209 X

FOREIGN PATENT DOCUMENTS 6-177607 6/1994 Japan ..... 333/202

*Primary Examiner*—Seungsook Ham
*Attorney, Agent, or Firm*—Ostrolenk, Faber, Gerb & Soffen, LLP

[57] ABSTRACT

A dielectric filter includes a pair of transverse electric $(TE)_{10}$-mode resonators connected in series. Each resonator has a conductor formed on substantially the entire surface of a dielectric body. On the connection surfaces of the resonators are formed grooves, respectively. On the inner surfaces of the grooves, central gaps are formed in the conductors. The pair of resonators are connected at their connection surfaces to combine the grooves to form a coupling-adjustment hole having an axis parallel to the interface between the resonators. The gaps combine to form a coupling window. The groove form a coupling-adjustment hole, through which the coupling window is accessible for being adjusted. The coupling window electromagnetically couples the pair of resonators.

15 Claims, 8 Drawing Sheets

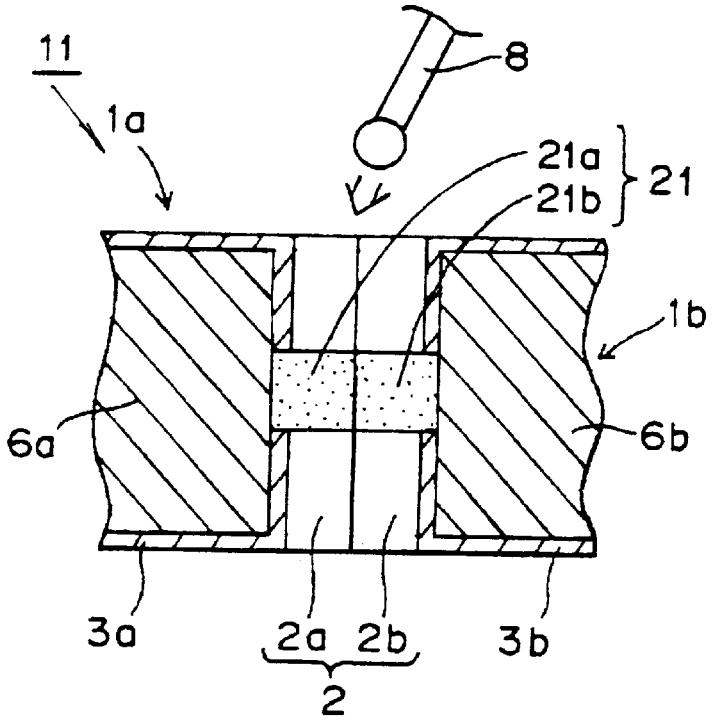
FIG. 3
FIG. 4
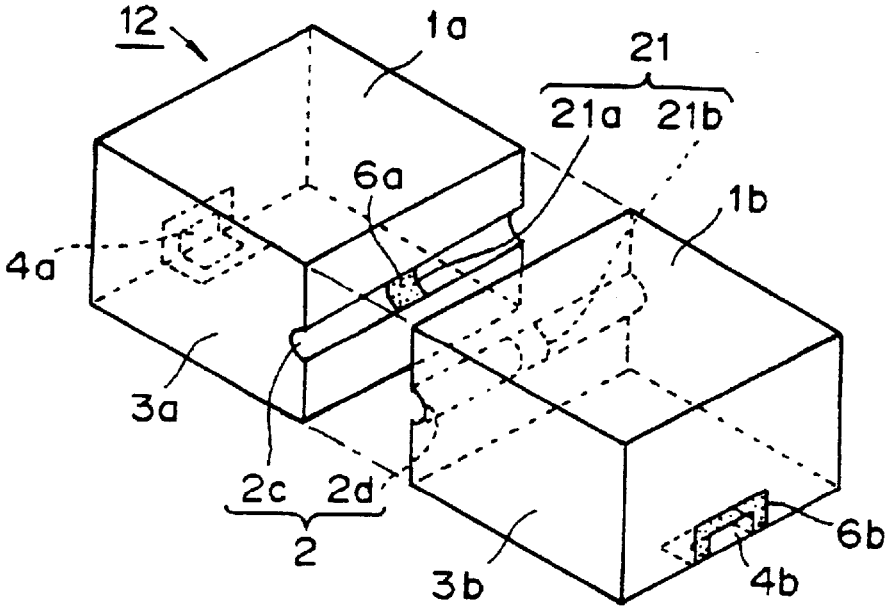

DIELECTRIC FILTER AND DIELECTRIC DUPLEXER

BACKGROUND OF THE INVENTION

1. Field of the Invention

The present invention relates to dielectric filters and dielectric duplexers, and in particular, to a dielectric filter and a dielectric duplexer for use in a microwave or milliwave-band communication apparatus or the like.

2. Description of the Related Art

As shown in FIG. 14, a known conventional dielectric filter 30 is formed by connecting in series transverse electric $(TE)_{10}$-mode dielectric resonators 31*a* and 31*b*. Conductors 33*a* and 33*b* are formed on substantially the entire surfaces of rectangular parallelepiped dielectric bodies 36*a* and 36*b*, except that on the connection surfaces of the resonators 31*a* and 31*b*, rectangular coupling windows 32*a* and 32*b* having no the conductors are respectively formed. Connecting the resonators 31*a* and 31*b* causes the coupling windows 32*a* and 32*b* to correspond to each other, and the resonators 31*a* and 31*b* are inductively or capacitively coupled via the coupling windows 32*a* and 32*b*. In this arrangement, the connection surfaces of the resonators 31*a* and 31*b* are not exposed to the outside of the dielectric filter 30. At ends of the resonators 31*a* and 31*b* are formed input/output electrodes 34*a* and 34*b* which are isolated from the conductors 33*a* and 33*b*. The resonators 31*a* and 31*b* are also provided with external coupling holes 35*a* and 35*b*. The central frequency of the dielectric filter 30 is determined by dimensions in the length direction (x direction denoted by an arrow in FIG. 12) and the width direction (y direction denoted by an arrow in FIG. 12) of the resonators 31*a* and 31*b*. In addition, other characteristics (the electromagnetic coupling amount, pass-band width, etc. between the resonators 31*a* and 31*b*) of the dielectric filter 30 are determined by the sizes of the coupling windows 32*a* and 32*b* and so forth.

In general, when the characteristics of a dielectric filter are to be adjusted, characteristics such as the pass-band width are measured, with a plurality of resonators connected to one another, and then the adjustment is performed by changing the sizes of the coupling windows 32*a* and 32*b* and so forth in accordance with the measured results. However, with the conventional dielectric filter 30, when the resonators 31*a* and 31*b* are connected to each other, the coupling windows 32*a* and 32*b* are not exposed at the outer surfaces of the dielectric filter 30. Accordingly, in order to expose the connection surfaces of the resonators 31*a* and 31*b* on which the coupling windows 32*a* and 32*b* are formed, it is necessary to separate the resonators 31*a* and 31*b*. In addition, after performing an adjustment by using a cutting tool like a router to cut the conductors 33*a* and 33*b* peripheral to the coupling windows 32*a* and 32*b* to change the sizes of the coupling windows 32*a* and 32*b* and so forth, the resonators 31*a* and 31*b* must be connected again. Accordingly, the adjustment operation is complicated. Also, after changing the sizes of the coupling windows 32*a* and 32*b* and so forth, it is difficult to restore the connection between the resonators 31*a* and 31*b* with preferable reproducibility, which causes a problem in the stability of the characteristic adjustment.

SUMMARY OF THE INVENTION

Accordingly, it is an object of the present invention to provide a dielectric filter and a dielectric duplexer whose characteristics can be adjusted, while resonators remain connected to each other.

To this end, according to the present invention, the foregoing object has been achieved through provision of a dielectric filter and a dielectric duplexer including a plurality of TE-mode resonators connected in series, the TE-mode resonators including dielectric bodies and conductors formed on surfaces of the dielectric bodies, in which a groove is formed on the connection surface of at least one of an adjacent pair of the TE-mode resonators. The surface in which the groove is formed and the connection surface of the other TE-mode resonator are joined to form a coupling-adjustment hole having a coupling window formed on the inner surface thereof and an axis parallel to the interface between the joined TE-mode resonators. The coupling window includes the formed groove and the corresponding portion of the other TE-mode resonator.

According to the present invention, a coupling window is formed in the inner surface of a coupling-adjustment hole formed in a dielectric filter or a dielectric duplexer, and therefore is accessible even without separating the pair of resonators. Accordingly, by inserting a cutting tool like a router into the coupling-adjustment hole, and cutting a conductor peripheral to the coupling window to change the size of the coupling window and so forth, characteristics of the dielectric filter can be adjusted, while the pair of resonators remain connected to each other.

BRIEF DESCRIPTION OF THE DRAWINGS

FIG. 3 is an enlarged sectional view showing the dielectric filter shown in FIG. 2.

FIG. 4 is an exploded perspective view showing a dielectric filter according to a second embodiment of the present invention.

DESCRIPTION OF THE PREFERRED EMBODIMENTS

Figure 1:
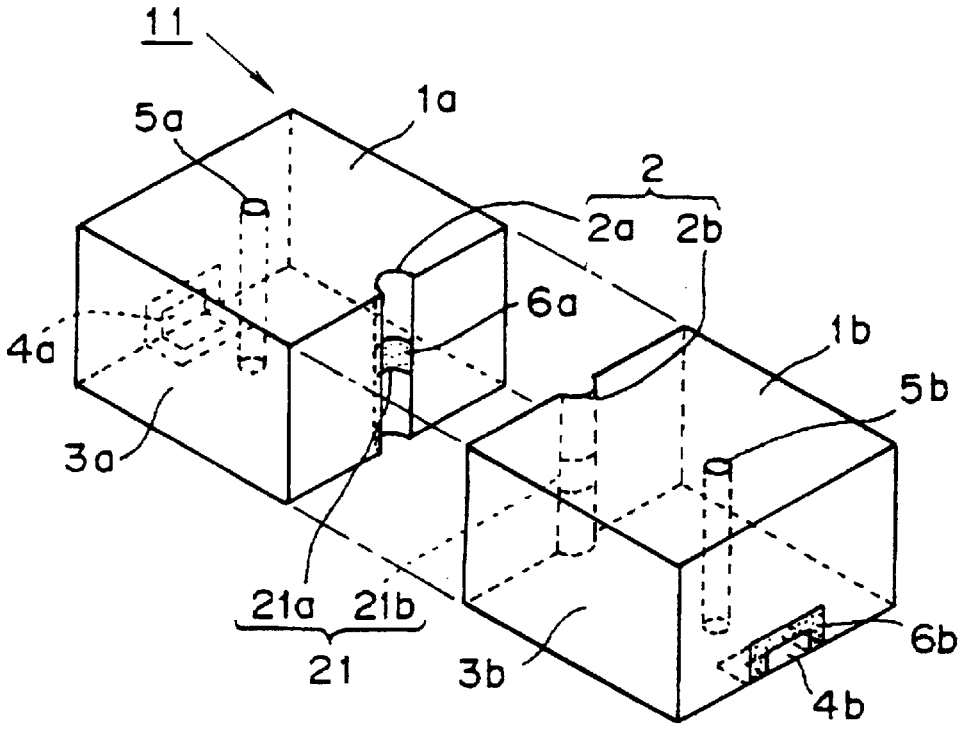
FIG. 1 is an exploded perspective view showing a dielectric filter according to a first embodiment of the present invention.

Dielectric filters according to the following embodiments of the present invention will be described below with reference to the attached drawings. In the embodiments, identical components and portions are denoted by identical reference numerals.

Figure 2:
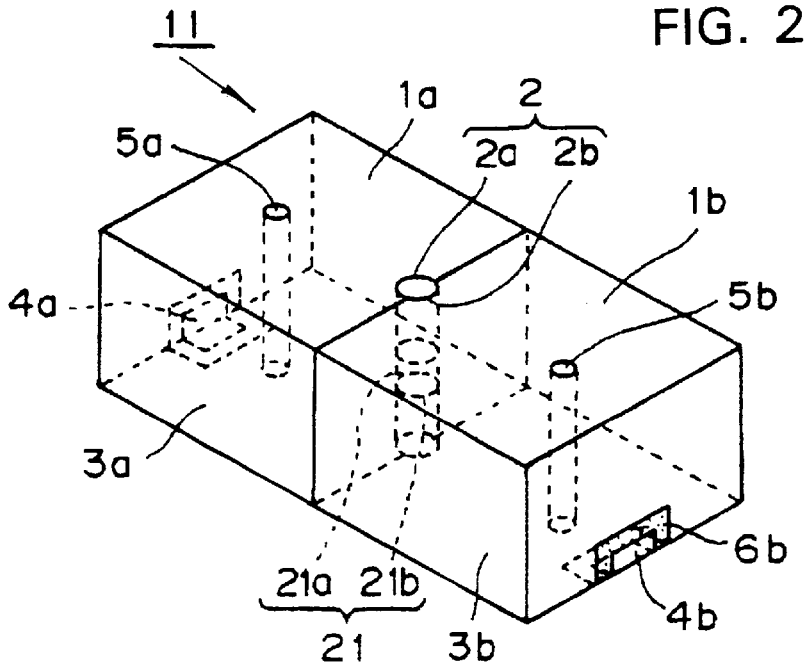
FIG. 2 is a perspective exterior view showing the dielectric filter shown in FIG. 1.

[First Embodiment: FIGS. 1 to 3]

As shown in FIG. 1, a dielectric filter 11 is formed by connecting in series $TE_{10}$-mode dielectric resonators 1*a* and 1*b* in which substantially the entire surfaces of dielectric bodies 6*a* and 6*b* are provided with conductors 3*a* and 3*b*. On the connection surfaces of the resonators 1*a* and 1*b*, which are cross-sectionally rectangular, cross-sectionally semicircular grooves 2*a* and 2*b* are formed from top to bottom of the resonators 1*a* and 1*b*. The conductors 3*a* and 3*b* are extended onto the inner round surfaces where the grooves 2*a* and 2*b*, excluding portions of central gaps 21*a* and 21*b*, are formed. At ends of the resonators 1*a* and 1*b* are formed input/output electrodes 4*a* and 4*b* which are not conductively connected to the conductors 3*a* and 3*b*, with predetermined distances provided between the input/output electrodes 4*a* and 4*b* and the conductors 3*a* and 3*b*, respectively. The resonators 1*a* and 1*b* are also provided with external coupling holes 5*a* and 5*b*, respectively. However, the external coupling holes 5*a* and 5*b* are not always necessary.

By joining the connection surfaces of the resonators 1*a* and 1*b* having the above structure, the dielectric filter 11 can be formed. As shown in FIG. 2, the grooves 2*a* and 2*b* of the resonators 1*a* and 1*b* combine to form a cross-sectionally circular coupling-adjustment hole 2 having an axis parallel to the interface. This coupling-adjustment hole 2 vertically penetrates the dielectric filter 11. The gaps 21*a* and 21*b*, formed on the inner round surfaces of the grooves 2*a* and 2*b*, combine to form an annular coupling window 21.

In the above-described dielectric filter 11, the resonators 1*a* and 1*b* are inductively or capacitively coupled by the coupling window 21. Characteristics (the electromagnetic coupling amount, pass-band width, etc. between the resonators 1*a* and 1*b*) of the dielectric filter 11 are determined by the size of the coupling window 21, and so forth. The coupling window 21 is accessible from the outside on the inner round surface of the coupling-adjustment hole 2, with the resonators 1*a* and 1*b* mutually connected.

The operation and advantages of the dielectric filter 11 will be described below with reference to a technique for adjusting characteristics such as a pass-band width.

First, characteristics of the dielectric filter 11, such as the pass-band width, are measured. Next, the size of the coupling window 21, and so forth, are changed based on the measured results. At this time, the coupling window 21 is accessible through the coupling-adjustment hole 2, without separating the resonators 1*a* and 1*b*. Thus, as shown in FIG. 3, by inserting a cutting tool 8 like a router into the coupling-adjustment hole 2, and cutting the conductors 3*a* and 3*b* peripheral to the coupling window 21, the size of the coupling window 21 and so forth can be changed. Accordingly, the characteristics of the dielectric filter 11 can be adjusted, with the resonators 1*a* and 1*b* mutually connected, which facilitates the adjustment operation. In addition, it is not necessary to disengage or restore the connection between the resonators 1*a* and 1*b*. This manner eliminates instability, in the adjustment of the conventional dielectric filter, caused by the difficulty of restoring the connection between the resonators 1*a* and 1*b* with preferable reproducibility.

[Second, Third, Fourth and Fifth Embodiments: FIGS. 4 to 7]

As shown in FIGS. 4, 5, 6 and 7, dielectric filters 12, 13, 14 and 15 according to second, third, fourth and fifth embodiments of the present invention have structures, identical to the structure of the dielectric filter 11 according to the first embodiment of the present invention, except for the grooves formed on the connection surfaces of resonators 1*a* and 1*b* in the second, third, fourth and fifth embodiments. On the connection surfaces of resonators 1*a* and 1*b* of the dielectric filters 12, 13, 14 and 15, grooves having various configurations are formed.

In each configuration, conductor-free gaps 21*a* and 21*b*, formed on the inner surfaces of the grooves 2*c* to 2*j*, combine to form a respective coupling window 21.

Figure 5:
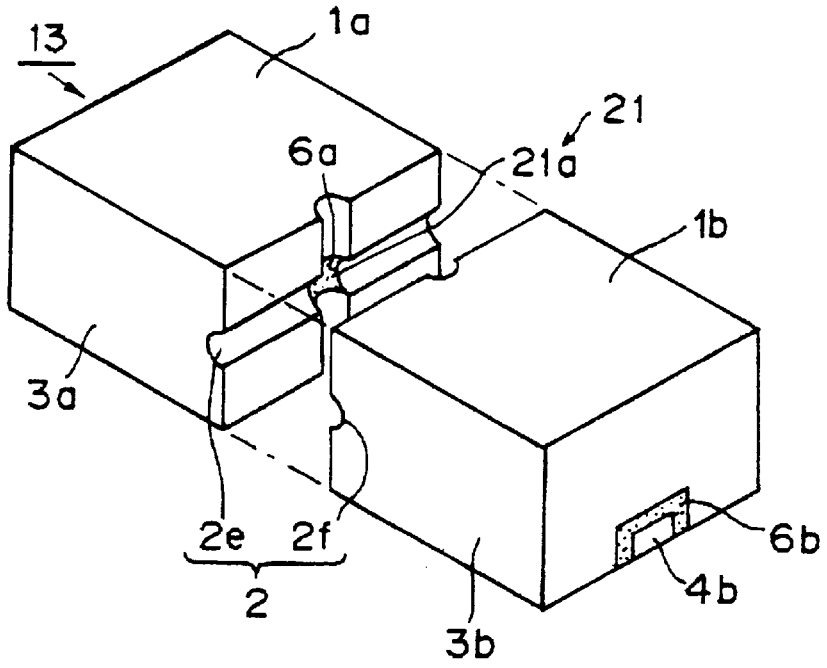
FIG. 5 is an exploded perspective view showing a dielectric filter according to a third embodiment of the present invention.
Figure 6:
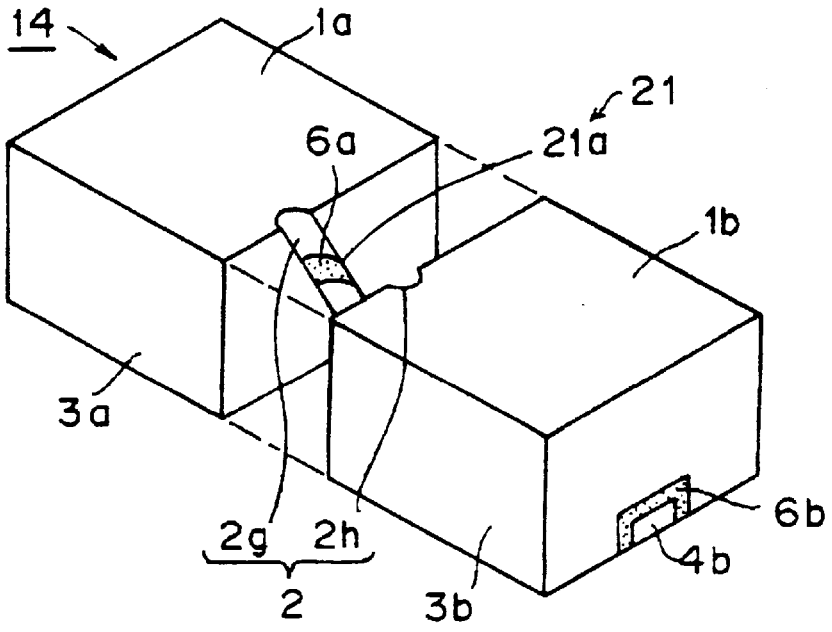
FIG. 6 is an exploded perspective view showing a dielectric filter according to a fourth embodiment of the present invention.
Figure 7:
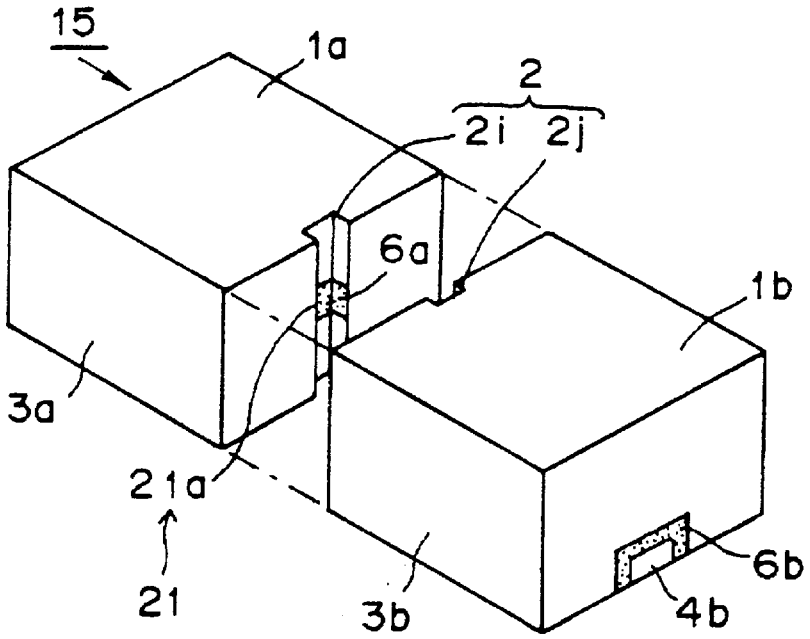
FIG. 7 is an exploded perspective view showing a dielectric filter according to a fifth embodiment of the present invention.

As shown in FIG. 4, the grooves 2*c* and 2*d* of the dielectric filter 12 according to the second embodiment are formed from the front side to the back side. Accordingly, the coupling-adjustment hole 2 horizontally penetrates the dielectric filter 12. As shown in FIG. 5, the grooves 2*e* and 2*f* of the dielectric filter 13 according to the third embodiment are formed by grooves which are formed from top to bottom of the resonators 1*a* and 1*b*, and grooves formed from the front side to the back side thereof, these grooves being combined to cross mutually. Accordingly, the coupling-adjustment hole 2 penetrates the dielectric filter 13 both horizontally and vertically. As shown in FIG. 6, the grooves 2*g* and 2*h* of the dielectric filter 14 according to the fourth embodiment are formed from top to bottom of the resonators 1*a* and 1*b* so as to incline at a non-right angle. Accordingly, the coupling-adjustment hole 2 penetrates the dielectric filter 14 at an incline with respect to the vertical direction. As shown in FIG. 7, the grooves 2*i* and 2*j* of the dielectric filter 15 according to the fifth embodiment are rectangular in cross-section and are combined to form the coupling-adjustment hole 2.

The operations and advantages of the dielectric filters 12, 13, 14 and 15, according to the second, third, fourth and fifth embodiments, are similar to those of the dielectric filter 11 according to the first embodiment. In addition, according to each embodiment, by changing the shape of the coupling-adjustment hole 2, a degree of freedom in dielectric-filter design can be enhanced.

Figure 8:
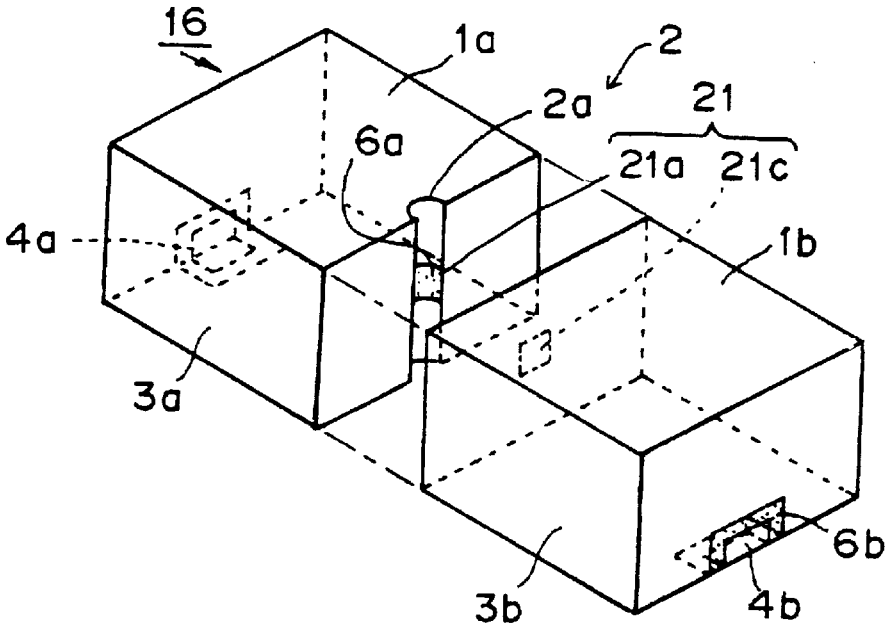
FIG. 8 is an exploded perspective view showing a dielectric filter according to a sixth embodiment of the present invention.

[Sixth Embodiment: FIG. 8]

As shown in FIG. 8, a dielectric filter 16 according to a sixth embodiment of the present invention has a structure similar to that of the dielectric filter 11 according to the first embodiment, except that a groove 2*a* is formed on the connection surface of only one resonator 1*a* and the connection surface of the other resonator 1*b* is provided with no groove, so as to be plane.

On the inner round surface of the groove 2*a* formed on the connection surface of the resonator 1*a*, excluding the portion of where a central gap 21*a* is formed, there is formed a conductor 3*a*. Also, on the connection surface of the resonator 1*b*, excluding the portion of where a plane rectangular gap 21*c* is opposed to the gap 21, there is formed a conductor 3*b*. Joining the connection surfaces of the resonators 1*a* and 1*b* forms a coupling-adjustment hole 2 having an axis parallel to the interface, which is composed of the groove 2*a* and the corresponding connection-surface portion of the resonator 1*b*. The coupling-adjustment hole 2 is cross-sectionally semicircular. The gaps 21*a* and 21*c* combine to form a coupling window 21.

The operations and advantages of the dielectric filter 16, according to the sixth embodiment, are similar to those of the dielectric filter 11 according to the first embodiment. In addition, according to the sixth embodiment, a degree of freedom in dielectric-filter design can be enhanced.

Figure 9:
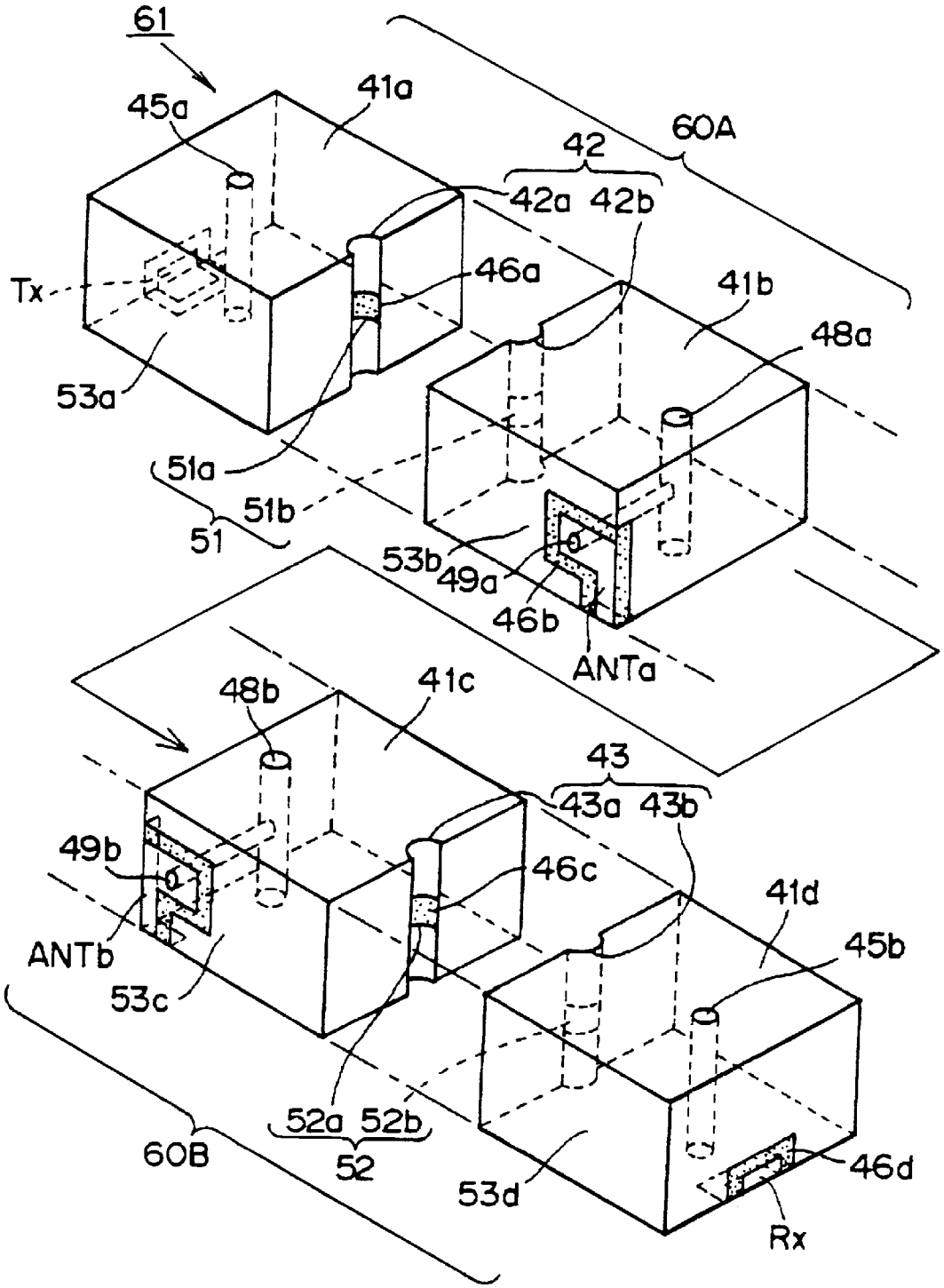
FIG. 9 is an exploded perspective view showing a dielectric duplexer according to a seventh embodiment of the present invention.
Figure 10:
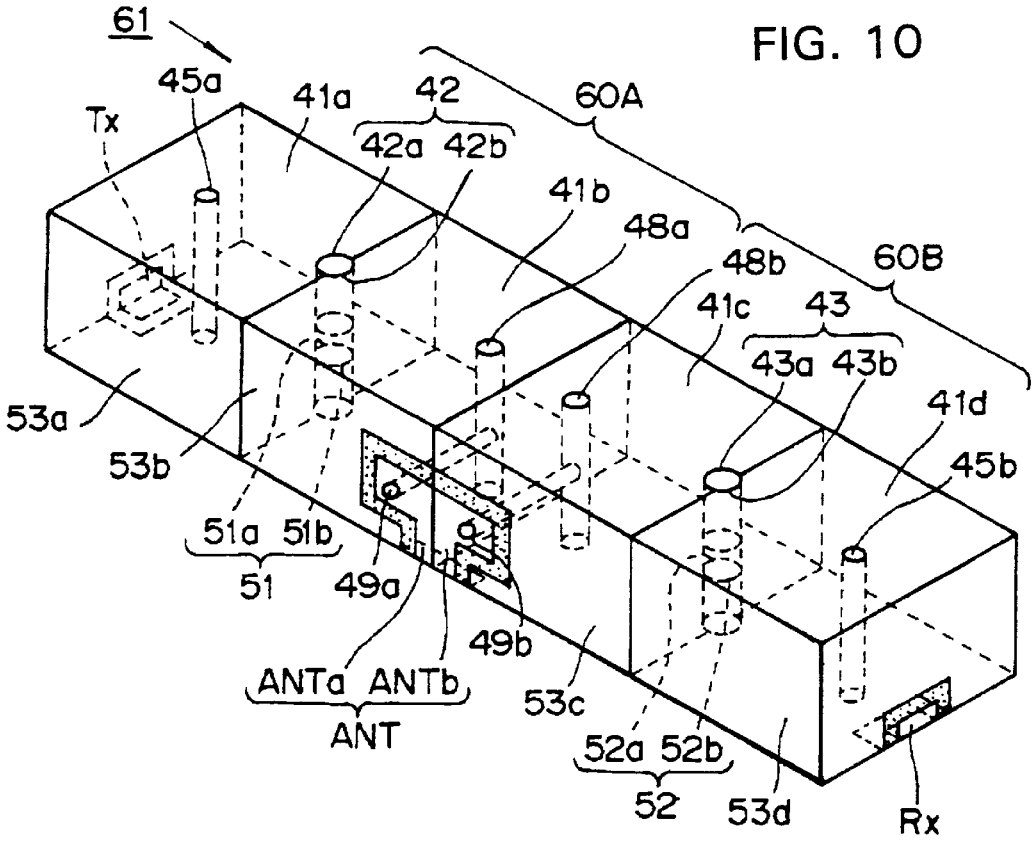
FIG. 10 is a perspective exterior view showing the dielectric duplexer of FIG. 9.

[Seventh Embodiment: FIGS. 9 and 10]

A description will now be given of a dielectric duplexer for use in mobile communication units, such as automobile telephones and mobile cellular telephones, according to a seventh embodiment of the present invention. A dielectric duplexer 61 is configured, as shown in FIG. 9, with $TE_{10}$ mode dielectric resonators 41*a*, 41*b*, 41*c* and 41*d*. Respective pairs of dielectric resonators 41*a*, 41*b* and 41*c*, 41*d* are connected in series with each other. The dielectric resonators have respective conductors 53*a*, 53*b*, 53*c* and formed on substantially the entire surfaces of dielectric members 46*a*, 46*b*, 46*c* and 46*d*, respectively. Grooves 42*a* and 42*b* having a semi-circular shape in cross section are respectively formed on the connecting surfaces of the resonators 41*a* and 41*b* in a direction from the upper surface to the lower surface of the resonators 41*a* and 41*b*. Similarly, grooves 43*a* and 43*b* having a semi-circular shape in cross section are respectively formed on the connecting surfaces of the resonators 41*c* and 41*d* in a direction from the upper surface to the lower surface of the resonators 41*c* and 41*d*. The conductors 53*a*, 53*b*, 53*c* and 53*d* respectively cover the inner peripheral surfaces of the grooves 42*a*, 42*b*, 42*c* and 42*d*, except for gaps 51*a*, 51*b*, 52*a* and 52*b* provided at the center of the grooves 42*a*, 42*b*, 43*a* and 43*b*, respectively.

A transmitting electrode Tx, an antenna electrode ANTa, an antenna electrode ANTb, and a receiving electrode Rx, which serve as input/output electrodes, are respectively formed on the surfaces of the resonators 41*a*, 41*b*, 41*c* and 41*d* while being spaced from the conductors 53*a*, 53*b*, 53*c* and 53*d* so as not to contact each other, respectively.

Further, external coupling holes 45*a* and 45*b* are formed from the upper surfaces to the lower surfaces of the resonators 41*a* and 41*d*, respectively. Likewise, external coupling holes 48*a* and 48*b* are formed from the upper surfaces to the lower surfaces of the resonators 41*b* and 41*c*, respectively. Leading through-holes 49*a* and 49*b* orthogonal to the external coupling holes 48*a* and 48*b*, respectively, are further provided. The conductors 53*b* and 53*c* cover the inner peripheral surfaces of the external coupling holes 48*a* and 48*b* and the leading through-holes 49*a* and 49*b*, respectively. The conductors 53*b* and 53*c* on the inner peripheral surfaces of the external coupling holes 48*a* and 48*b* are partially trimmed to adjust the impedance. The leading through-holes 49*a* and 49*b* are electrically connected at one end to the antenna electrodes ANTa and ANTb, respectively. Accordingly, the external coupling holes 48*a* and 48*b* are electrically connected to the antenna electrodes ANTa and ANTb via the leading through-holes 49*a* and 49*b*, respectively.

The connecting surfaces of the respective resonators 41*a* through 41*d* constructed as described above are coupled to form a dielectric duplexer 61. At this time, the grooves 42*a* and 42*b* of the respective resonators 41*a* and 41*b* are combined, as shown in FIG. 10, to form a coupling adjustment hole 42 having a circular shape in cross section and having an axis parallel to the connecting surfaces of the resonators 41*a* and 41*b*. The gaps 51*a* and 51*b* provided on the inner peripheral surfaces of the grooves 42*a* and 42*b*, respectively, are combined to form a ring-like coupling window 51. Similarly, the grooves 43*a* and 43*b* of the respective resonators 41*c* and 41*d* form a coupling adjustment hole 43 having a circular shape in cross section and having an axis parallel to the connecting surfaces of the resonators 41*c* and 41*d*. The gaps 52*a* and 52*b* provided on the inner peripheral surfaces of the grooves 43*a* and 43*b*, respectively, form a ring-like coupling window 52. Moreover, the antenna electrode ANTa and the antenna electrode ANTb of the respective resonators 41*b* and 41*c* are combined to form an antenna electrode ANT.

In the dielectric duplexer 61 configured as described above, the resonators 41*a* and 41*b* are inductively or capacitively coupled through the coupling window 51, thereby forming a transmitting filter (band-pass filter) 60A. The resonators 41*c* and 41*d* are inductively or capacitively coupled through the coupling window 52 to form a receiving filter (band-pass filter) 60B. The characteristics (such as the electromagnetic coupling amount between the resonators 41*a* and 41*b* or the resonators 41*c* and 41*d* and the pass bandwidth) of the dielectric duplexer 61 are determined by the size of the coupling window 51 or 52. The coupling windows 51 and 52 are exposed on the inner peripheral surfaces of the coupling adjustment holes 42 and 43, respectively, after the resonators 41*a* and 41*b* and the resonators 41*c* and 41*d* have been interconnected.

In the dielectric duplexer 61, a transmitting signal sent from a transmitting circuit system (not shown) to the transmitting electrode Tx is output from the antenna electrode ANT via the transmitting filter 60A, and a receiving signal input into the antenna electrode ANT is output to a receiving circuit system (not shown) from the receiving electrode Rx via the receiving filter 60B.

The operation and advantages of the dielectric duplexer 61 will now be described with reference to a method of adjusting its characteristics, such as the pass bandwidth, as an example.

The characteristics, such as the pass bandwidth, are measured after the resonators 41*a*, 41*b*, 41*c* and 41*d* have been connected. Based on the measurements, the sizes of the coupling windows 51 and 52 are changed, for example, in the following manner. The coupling windows 51 and 52 are accessibly located on the inner peripheral surfaces of the coupling adjustment holes 42 and 43, respectively, without requiring the resonators 41*a* and 41*b* and the resonators 41*c* and 41*d* to be disconnected. It is thus possible to insert a cutting instrument, such as a router, into the holes 42 and 43 from the openings of the coupling adjustment holes 42 and 43, respectively, and to trim the conductors 53*a* and 53*b* and the conductors 53*c* and 53*d* formed around the coupling windows 51 and 52, respectively.

Thus, adjustments can be made to the characteristics of the dielectric duplexer 61 while the resonators 41*a*, 41*b*, 41*c* and 41*d* are connected to each other, thereby making the adjusting operation easier. Moreover, it is unnecessary to disconnect and re-connect the resonators 41*a*, 41*b*, 41*c* and 41*d*, which would otherwise cause the problem of unstable adjustment experienced by the known dielectric duplexer owing to poor reproducibility of re-connecting the resonators 41*a*, 41*b*, 41*c* and 41*d*.

[Eighth Embodiment]

A dielectric filter and a dielectric duplexer according to the present invention are not limited to the foregoing embodiments, but may be variously modified while still employing the gist of the present invention.

Figure 11:
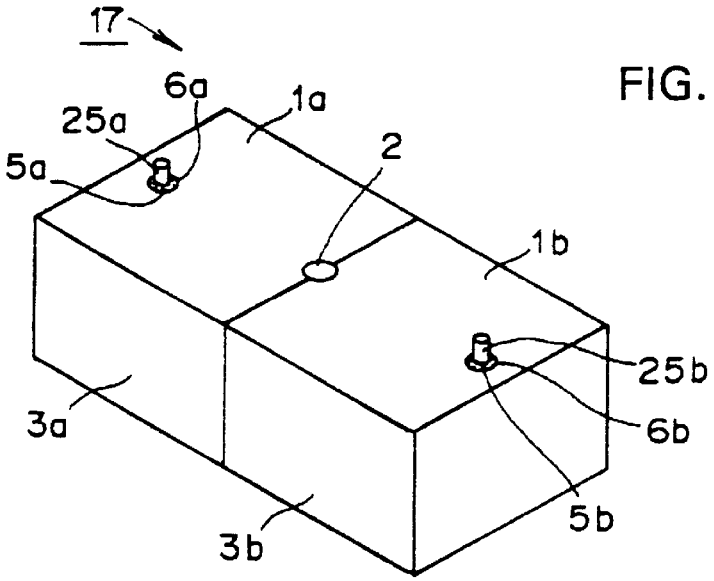
FIG. 11 is a perspective exterior view showing a dielectric filter according to an eighth embodiment of the present invention.

As shown in FIG. 11, input/output electrodes are not formed at the ends of a dielectric filter 17. Instead, by inserting conductive pins 25*a* and 25*b* into external coupling holes 5*a* and 5*b*, the dielectric filter 17 may be coupled to an external circuit by the conductive pins 25*a* and 25*b*. In this case, surrounding the external coupling holes 5*a* and 5*b* are gaps 6*a* and 6*b* which isolate the conductors 3*a* and 3*b* from the conductive pins 25*a* and 25*b*.

Figure 12:
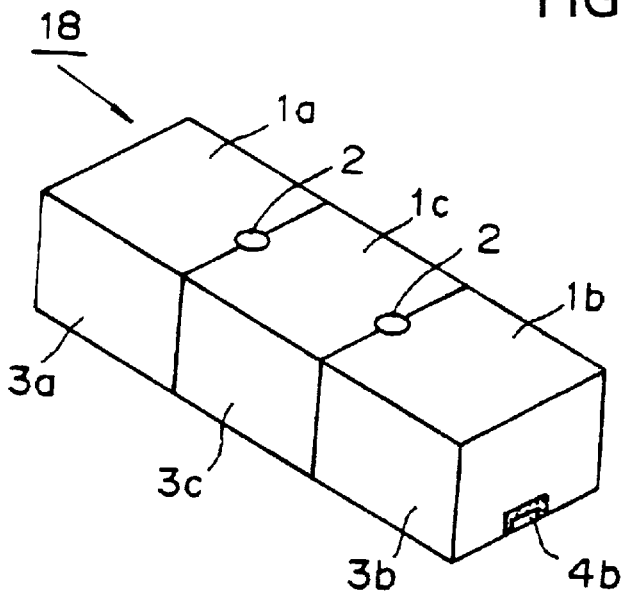
FIG. 12 is a perspective exterior view showing a dielectric filter according to a ninth embodiment of the present invention.

In the first through sixth and the eighth embodiments, the dielectric filters 11 to 17 described have included two resonators 1*a* and 1*b*. In the seventh embodiment, the dielectric filters 60A and 60B also included respective pairs of resonators. However, as shown in FIG. 12, by connecting in series three resonators 1*a*, 1*b* and 1*c* or more, a dielectric filter 18 may be formed. In this case, at each side of the resonator 1*c*, which is centrally disposed, there is formed a coupling-adjustment hole 2.

Figure 13:
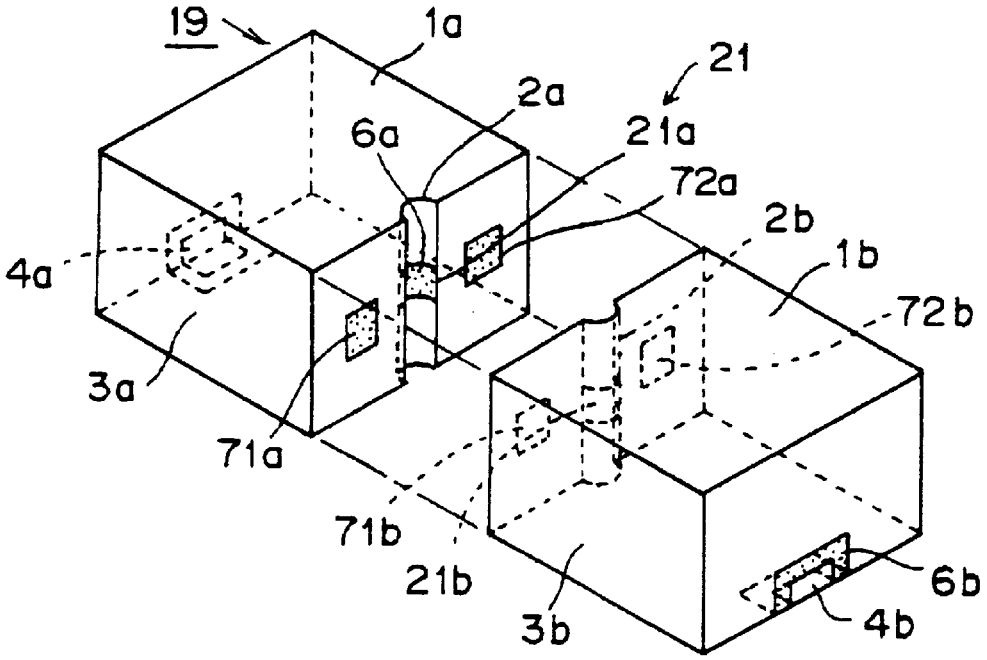
FIG. 13 is an exploded perspective view showing a dielectric filter according to a tenth embodiment of the present invention.
Figure 14:
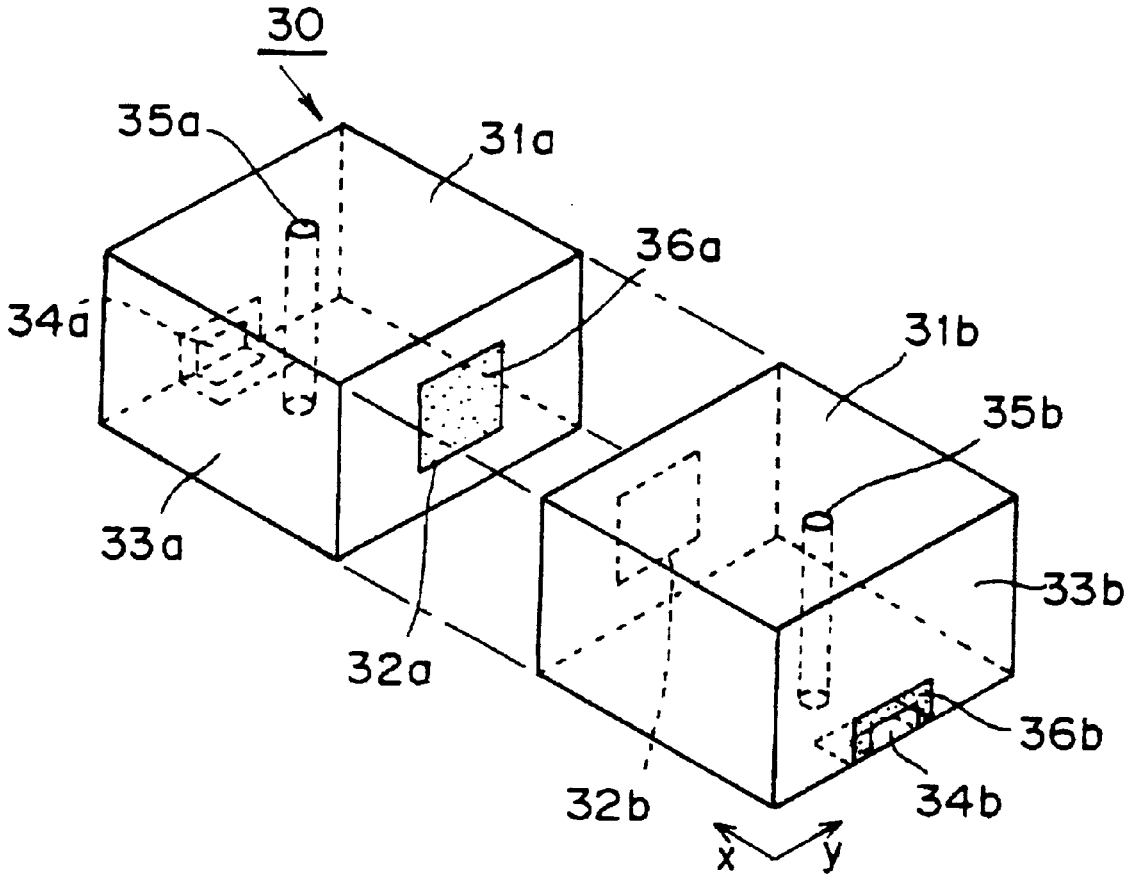
FIG. 14 PRIOR ART
FIG. 14 is an exploded perspective view showing a conventional dielectric filter.

As shown in FIG. 13, in addition to grooves 2*a*, 2*b*, and respective gaps 21*a* and 21*b* which form corresponding coupling windows, additional rectangular coupling windows 71*a*, 71*b*, 72*a* and 72*b* may be formed. Connecting the resonators 1*a* and 1*b* causes the coupling windows 71*a* and 71*b* to correspond mutually, and causes the coupling windows 72*a* and 72*b* to correspond mutually. Accordingly, the resonators 1*a* and 1*b* are electromagnetically coupled to the coupling window 21 composed of the gaps 21*a* and 21*b* by the coupling windows 71*a* to 72*b*.

In each embodiment, the resonators may be connected together either after forming the conductors, input/output electrodes and gaps on the surfaces of the resonators, or after forming the conductors and the gaps on the connection surfaces of the resonators, but before forming the conductors and the input/output electrodes on the other surfaces of the resonators. Also, instead of forming the coupling windows before assembly of the resonators, a coupling window may be formed on the inner surface of the coupling-adjustment hole after forming conductors on the entire internal surfaces of the grooves, and combining the resonators to form a coupling-adjustment hole, by inserting a cutting tool like a router into the coupling-adjustment hole. The cross-sectional shape of each groove is arbitrary. And, although in the foregoing embodiments, one coupling-adjustment hole is formed for each connection surface, the number of coupling adjustment holes is not always limited to one, but rather a plurality of coupling adjustment holes may be formed on each connection surface.

While the invention has been particularly shown and described with reference to preferred embodiments thereof, it will be understood by those skilled in the art that the forgoing and other changes in form and details may be made therein without departing from the spirit of the invention.

What is claimed is:

1. A dielectric filter, comprising:

a pair of transverse electric (TE)-mode resonators connected in series to each other at corresponding connection surfaces thereof, said TE-mode resonators including dielectric bodies and conductors provided on at least parts of outer surfaces of said dielectric bodies including said connection surfaces, a groove provided on the connection surface of at least a first one of said pair of TE-mode resonators, and the groove being joined to the connection surface of the second TE-mode resonator to provide a coupling-adjustment hole having an axis parallel to the connection surfaces of the joined TE-mode resonators, and a coupling window including a conductor-free portion of the groove and a corresponding conductor-free portion of the connection surface of the second TE-mode resonator.

2. A dielectric filter as in claim 1, wherein said groove is semi-circular in cross-section.

3. A dielectric filter as in claim 1, wherein said groove is rectangular in cross-section.

4. A dielectric filter as in claim 1, further comprising a pair of additional conductor-free portions, each being disposed on a respective one of said connection surfaces and spaced away from the corresponding groove therein, said pair of additional conductor-free portions facing each other so as to provide an additional coupling window between said first and second TE-mode resonators.

5. A dielectric filter as in claim 1, further comprising a second groove provided on the connection surface of said second TE-mode resonator and coaxial with said groove on said first TE-mode resonator, said conductor-free portion of said second TE-mode resonator being disposed in said second groove and facing said conductor-free portion of said first TE-mode resonator.

6. A dielectric filter as in claim 5, further comprising a pair of additional conductor-free portions, each being disposed on a respective one of said connection surfaces and spaced away from the corresponding groove therein, said pair of additional conductor-free portions facing each other so as to provide an additional coupling window between said first and second TE-mode resonators.

7. A dielectric filter as in claim 5, wherein said grooves are disposed at right angles to corresponding sides of said dielectric bodies.

8. A dielectric filter as in claim 5, wherein said grooves are disposed at non-right angles to corresponding sides of said dielectric bodies.

9. A dielectric filter as in claim 5, further comprising third and fourth grooves provided respectively on the connection surfaces of said first and second TE-mode resonators, said third and fourth grooves being aligned with and facing each other and intersecting said first and second grooves, respectively.

10. A dielectric filter as in claim 9, wherein said third and fourth grooves intersect said first and second grooves at said first and second conductor-free portions.

11. A dielectric filter as in claim 9, wherein said third and fourth grooves intersect said first and second grooves at right angles.

12. A dielectric duplexer comprising:

two filters, a common terminal connected to both of said filters, and a pair or input/output terminals each connected to a respective one of said filters; each of said filters comprising:

pair of transverse electric (TE)-mode resonators connected in series to each other at corresponding connection surfaces thereof, said TE-mode resonators including dielectric bodies and conductors provided on at least parts of outer surfaces of said dielectric bodies including said connection surfaces, a groove provided on the connection surface of at least a first one of said pair of TE-mode resonators, and the groove being joined to the connection surface of the second TE-mode resonator to provide a coupling-adjustment hole having an axis parallel to the connection surfaces of the joined TE-mode resonators, and a coupling window including a conductor-free portion of the groove and a corresponding conductor-free portion of the connection surface of the second TE-mode resonator.

13. A dielectric duplexer as in claim 12, wherein said groove is semi-circular in cross-section.

14. A dielectric duplexer as in claim 12, further comprising a second groove provided on the connection surface of said second TE-mode resonator and coaxial with said groove on said first TE-mode resonator, said conductor-free portion of said second TE-mode resonator being disposed in said second groove and facing said conductor-free portion of said first TE-mode resonator.

15. A dielectric duplexer as in claim 14, wherein said grooves are disposed at right angles to corresponding sides of said dielectric bodies.

* * * * *